US007555909B2

(12) United States Patent
Chang

(10) Patent No.: US 7,555,909 B2
(45) Date of Patent: Jul. 7, 2009

(54) METHOD OF FULLY FREEZING ICE AND REFRIGERATOR USING THE SAME

(75) Inventor: Jae-hyeok Chang, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 576 days.

(21) Appl. No.: 11/336,941

(22) Filed: Jan. 23, 2006

(65) Prior Publication Data

US 2006/0266056 A1 Nov. 30, 2006

(30) Foreign Application Priority Data

May 31, 2005 (KR) ..... 10-2005-0046206

(51) Int. Cl.
*F25C 1/12* (2006.01)

(52) U.S. Cl. ..... 62/66; 62/135; 62/208

(58) Field of Classification Search ..... 62/66, 62/135, 208–209, 353
See application file for complete search history.

(56) References Cited

U.S. PATENT DOCUMENTS

| | | | | |
|---|---|---|---|---|
| 3,977,851 | A * | 8/1976 | Toya | 62/135 |
| 5,129,237 | A * | 7/1992 | Day et al. | 62/73 |
| 5,768,900 | A * | 6/1998 | Lee, II | 62/137 |
| 5,778,686 | A * | 7/1998 | Choi | 62/71 |
| 6,349,550 | B1 | 2/2002 | Shapiro et al. | |
| 2002/0007638 | A1 | 1/2002 | Tchougounov et al. | |

FOREIGN PATENT DOCUMENTS

| | | |
|---|---|---|
| EP | 1 450 230 | 8/2004 |
| KR | 1996-0031925 | 9/1996 |
| KR | 100221145 | 6/1999 |
| KR | 2002-12442 | 2/2002 |

OTHER PUBLICATIONS

European Search Report mailed Mar. 26, 2009 issued with respect to the corresponding European Patent Application No. 06009578.3-2301.

* cited by examiner

*Primary Examiner*—William E Tapolcai
(74) *Attorney, Agent, or Firm*—Staas & Halsey LLP

(57) ABSTRACT

A method of fully freezing ice in a refrigerator. The method includes setting a full-frozen temperature for determining whether ice is fully frozen, and a reference ambient temperature for re-adjusting the full-frozen temperature; supplying water to the ice-making tray to thereby perform ice-making; sensing ambient temperature; sensing temperature of the ice-making tray; re-adjusting the full-frozen temperature by comparing the sensed ambient temperature with the reference ambient temperature; and if the temperature of the ice-making tray reaches the re-adjusted full-frozen temperature, driving an ice-transfer motor to transfer full-frozen ice from the ice-making tray.

Thus, not fully frozen ice is prevented from being transferred, to thereby improve ice quality and avoid sticking of ice, which may occur when not fully frozen ice is broken while being transferred. A refrigerator using such a method is also disclosed.

8 Claims, 6 Drawing Sheets

FIG. 6

| AMBIENT TEMPERATURE / FULL-FROZEN TEMPERATURE | 3°C - 7°C | 8°C - 12°C | ABOVE 13°C |
|---|---|---|---|
| INITIAL FULL-FROZEN TEMPERATURE ($T_R$) | -17°C | -17°C | -17°C |
| RE-ADJUSTED FULL-FROZEN TEMPERATURE ($T'_R$) | -20°C | -17°C | -17°C |
| INITIAL ICE-TRANSFER STANDBY TIME ($t_R$) | 5 MINUTES | 5 MINUTES | 5 MINUTES |
| EXTEND ICE-TRANSFER STANDBY TIME ($t'_R$) | 7-10 MINUTES | 5 MINUTES | 5 MINUTES |

METHOD OF FULLY FREEZING ICE AND REFRIGERATOR USING THE SAME

CROSS-REFERENCE TO RELATED APPLICATIONS

This application claims the benefit of Korean Application No. 2005-0046206, filed on May 31, 2005, in the Korean Intellectual Property Office, the disclosure of which is incorporated herein by reference.

BACKGROUND OF THE INVENTION

1. Field of the Invention

The present invention relates, in general, to a method of fully freezing ice and a refrigerator using the same, more particularly, to a method of fully freezing ice and a refrigerator using such method, in which fully-frozen ice can be provided at lower ambient temperatures.

2. Description of the Related Art

A refrigerator is an apparatus where various foods remain fresh for an extended period of time, using air heat-exchanged in an evaporator during a freezing cycle. Such refrigerators include a freezer for storing frozen foods such as meat and fish below their freezing temperature, and a cold storage for storing cold-storage foods such as fruits and vegetables above their freezing temperature.

In general, a freezer 20 is provided at its upper portion with an ice-maker 40 supplied with water from the outside for making ice, and an ice-storage 30 for storing the ice transferred from the ice-maker 40. Referring to FIG. 1, the ice-making and ice-transferring procedures will be explained. First, water is supplied from an external water supply via a water-supply valve (not shown) and a water-supply tube 45 to an ice-making tray 41. The supplied water starts to be frozen by cold air in the freezer 20. Below the ice-making tray 41 is provided an ice-making temperature sensor 80 for detecting the temperature of the ice-making tray 41. If the temperature of the ice-making tray 41 reaches a pre-determined fully-frozen temperature, the ice-making procedures are completed and, after a desired period of ice-transfer standby time, the ice is transferred. An ice-transfer motor 47 is provided at one side of the ice-making tray 41. The ice-transfer motor 47 turns the ice-making tray 41 at a certain angle to allow the frozen ice to be transferred into the ice-storage 30. On the other hand, at the other side of the ice-making tray 41 is provided an ice-full sensing lever for sensing the quantity of ice stored in the ice-storage 30.

In the conventional refrigerator described above, however, whether the frozen ice is to be transferred is determined considering only the temperature of the ice-making tray. Thus, a problem occurs that the ice is transferred from the ice-making tray even when it is not completely frozen, depending upon ambient temperature. This phenomenon occurs because, in a case of a lower ambient temperature, even if the compressor of the refrigerator is operated for a relatively short period of time, the controlled temperature of the freezer can be easily met. Therefore, the ice is transferred before it is fully frozen, in particular, before the inside thereof is not completely frozen, thereby degrading the ice quality. In addition, when the not-fully frozen ice drops into the ice storage, it is likely to be broken and stick together inside the ice storage.

SUMMARY OF THE INVENTION

Additional aspects and/or advantages of the invention will be set forth in part in the description which follows and, in part, will be apparent from the description, or may be learned by practice of the invention.

Accordingly, it is an aspect of the invention to provide a method of fully freezing ice and a refrigerator using the method, in which fully-frozen ice can be provided regardless of ambient temperature to thereby improve the ice quality, thereby preventing the ice from sticking together inside an ice storage.

The foregoing and/or other aspects of the present invention are achieved by providing a method of fully freezing ice in a refrigerator, which includes an ice-making tray and an ice-transfer motor for turning the ice-making tray to transfer frozen ice. The method includes setting a full-frozen temperature for determining whether ice is fully frozen, and a reference ambient temperature for re-adjusting the full-frozen temperature; supplying water to the ice-making tray to thereby perform ice-making; sensing ambient temperature; sensing temperature of the ice-making tray; re-adjusting the full-frozen temperature by comparing the sensed ambient temperature with the reference ambient temperature; and if the temperature of the ice-making tray reaches the re-adjusted full-frozen temperature, driving an ice-transfer motor to transfer full-frozen ice from the ice-making tray.

According to an exemplary embodiment of the present invention, the re-adjusting the full-frozen temperature may include, if the sensed ambient temperature is lower than the reference ambient temperature, downwardly re-adjusting the full-frozen temperature.

According to an exemplary embodiment of the present invention, the method may further include setting an ice-transfer standby time of from when the ice-making tray reaches the full-frozen temperature to when the ice-transfer motor is driven; and if the temperature of the ice-making tray reaches the re-adjusted full-frozen temperature, driving the ice-transfer motor when the ice-transfer standby time elapses.

According to an exemplary embodiment of the present invention, the method may further include, if the ambient temperature is lower than the reference ambient temperature, extending the ice-transfer standby time; if the temperature of the ice-making tray reaches the re-adjusted full-frozen temperature, driving the ice-transfer motor when the extended ice-transfer standby time elapses.

According to an exemplary embodiment of the present invention, the reference ambient temperature may be set to be in a range of 7~9° C.

According to an exemplary embodiment of the present invention, the set full-frozen temperature may be in a range of −17~−18° C. and the re-adjusted full-frozen temperature may be in a range of −20~−21° C.

According to an exemplary embodiment of the present invention, the ice-transfer standby time may be five minutes and the extended ice-transfer standby time may be 7~10 minutes.

The foregoing and/or other aspects of the present invention are also achieved by providing a method of fully freezing ice in a refrigerator, which includes an ice-making tray and an ice-transfer motor for turning the ice-making tray to transfer frozen ice. The method includes setting a full-frozen temperature for determining whether ice is fully frozen, an ice-transfer standby time at the full-frozen temperature, and a reference ambient temperature for re-adjusting the ice-transfer standby time; supplying water to the ice-making tray to thereby perform ice-making; sensing ambient temperature; sensing temperature of the ice-making tray; if the sensed ambient temperature is lower than the reference ambient temperature, extending the ice-transfer standby time; and if the temperature of the ice-making tray reaches the full-frozen temperature and when the ice-transfer standby time elapses, driving an ice-transfer motor to transfer full-frozen ice from the ice-making tray.

The foregoing and/or other aspects of the present invention are also achieved by providing a refrigerator having an ice-making tray and an ice-transfer motor for turning the ice-making tray to transfer frozen ice, including an ice-making temperature sensor for sensing temperature of the ice-making tray; an ambient temperature sensor for sensing ambient temperature; and a controller having a memory unit where a reference ambient temperature and a full-frozen temperature are set and stored, re-adjusting the full-frozen temperature by comparing the ambient temperature sensed by the ambient temperature sensor with the reference ambient temperature and, if the ice-making temperature sensor senses the re-adjusted full-frozen temperature, driving the ice-transfer motor.

According to an exemplary embodiment of the present invention, if the sensed ambient temperature is lower than the reference ambient temperature, the controller may downwardly re-adjust the full-frozen temperature by certain desired degrees.

According to an exemplary embodiment of the present invention, the controller may drive the ice-transfer motor when a desired ice-transfer standby time elapses after the ice-making temperature sensor senses the re-adjusted full-frozen temperature.

According to an exemplary embodiment of the present invention, the controller may extend the ice-transfer standby time when the ambient temperature sensed by the ambient temperature sensor is lower than the reference ambient temperature, and, if the ice-making temperature sensor senses the re-adjusted full-frozen temperature, drive the ice-transfer motor when the extended ice-transfer standby time elapses.

The foregoing and/or other aspects of the present invention are also achieved by providing a refrigerator having an ice-making tray and an ice-transfer motor for turning the ice-making tray to transfer frozen ice, including an ice-making temperature sensor for sensing temperature of the ice-making tray; an ambient temperature sensor for sensing ambient temperature; and a controller having a memory unit where a reference ambient temperature and a full-frozen temperature are set and stored, extending a set ice-transfer standby time if the ambient temperature sensed by the ambient temperature sensor is lower than the reference ambient temperature and, if the ice-making temperature sensor senses the set full-frozen temperature, drives the ice-transfer motor when the extended ice-transfer standby time elapses.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 6 is a table showing fully-frozen requirements depending on ambient temperatures.

DETAILED DESCRIPTION OF THE PREFERRED EMBODIMENTS

Figure 1:
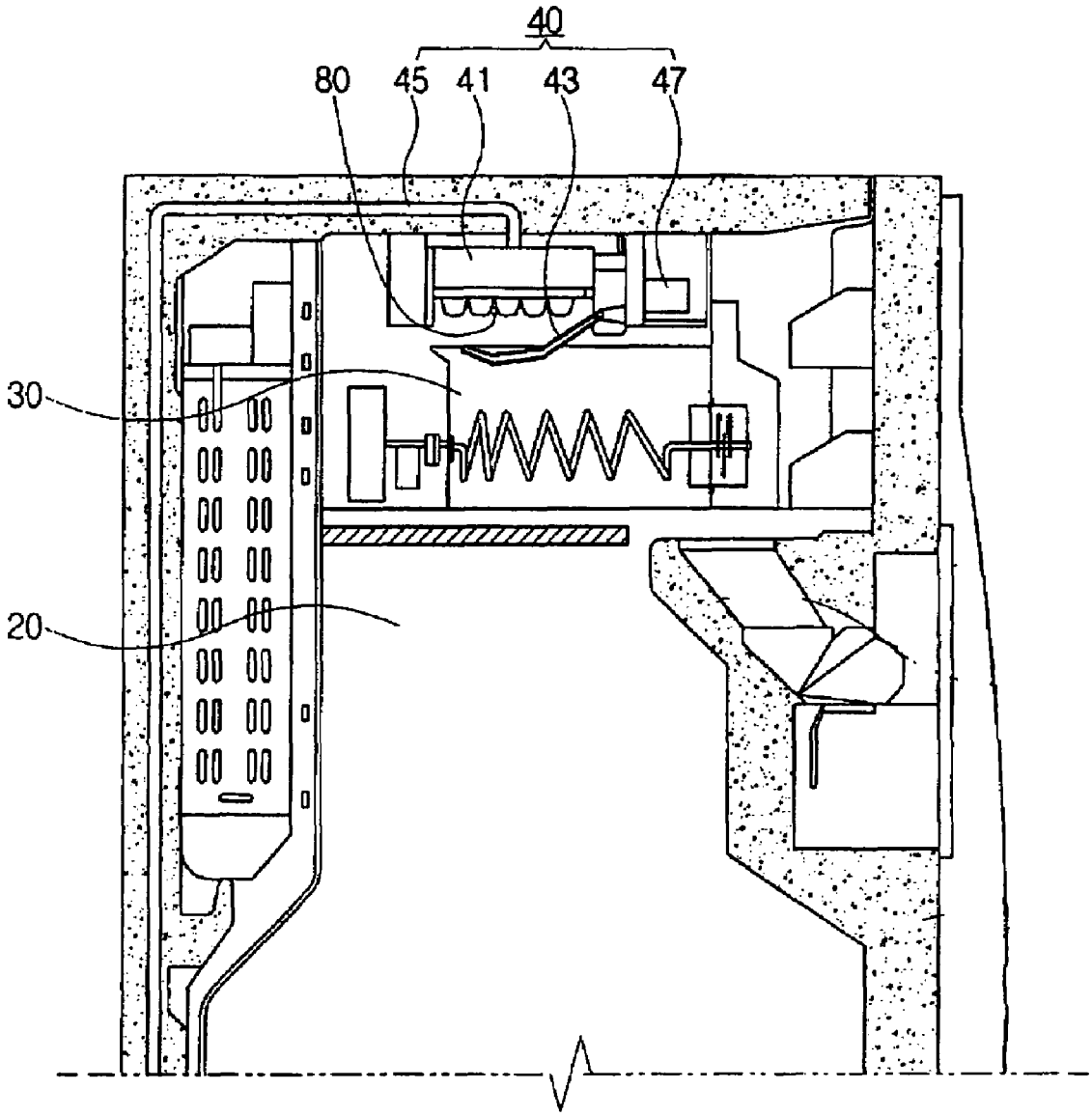
FIG. 1 PRIOR ART
FIG. 1 is a sectional view of a freezer in a conventional refrigerator.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
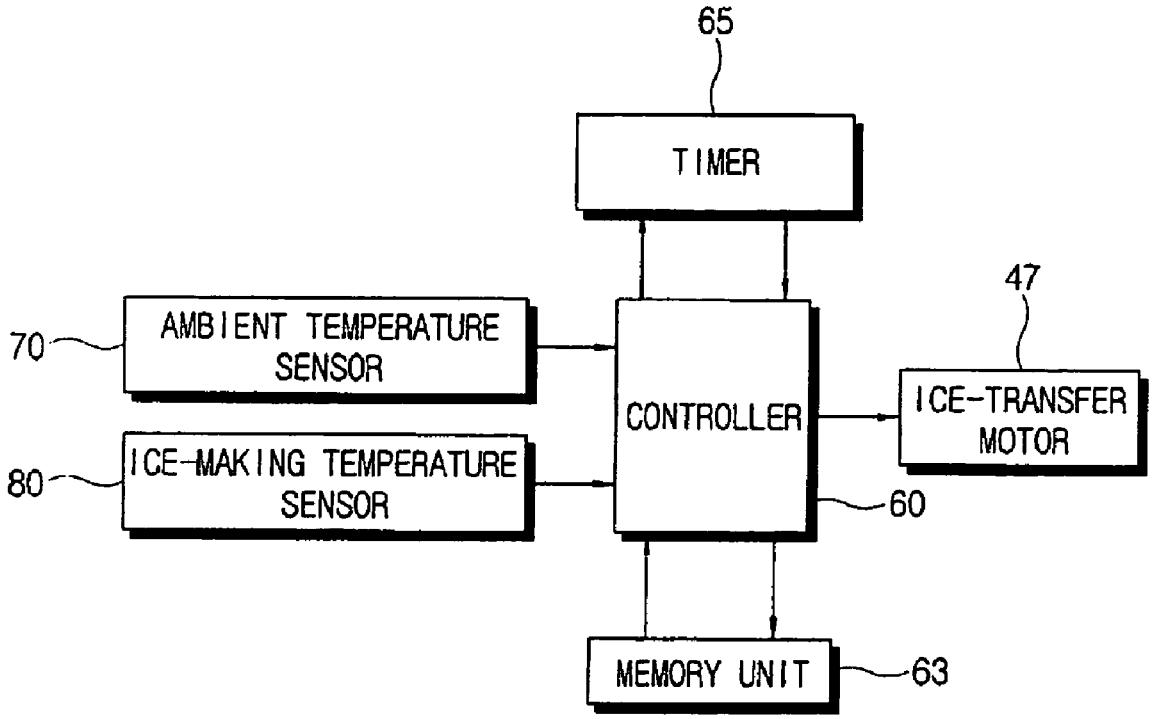
FIG. 2 is a block diagram schematically illustrating a refrigerator according to the present invention.

FIG. 2 is a block diagram schematically illustrating a refrigerator according to the present invention. Referring to FIG. 2, the refrigerator of the invention includes an ice-making temperature sensor 80 for detecting the temperature $T_I$ of an ice-making tray 41, an ambient temperature sensor 70 for sensing ambient temperature $T_s$, and a controller 60. When the ambient temperature $T_s$ detected by the ambient temperature sensor 70 is lower than a reference ambient temperature $T_{so}$, the controller 60 operates to lower and re-adjust a set full-frozen temperature $T_R$ by certain degrees. If the temperature $T_I$ of the ice-making tray 41 sensed by the ice-making temperature sensor 80 reaches re-adjusted full-frozen temperature $T'_R$, the controller 60 drives an ice-transfer motor 47. Here, the refrigerator of the invention may further include a timer 65 for counting an ice-transfer standby time $t_R$, and a memory unit 63 for storing the reference ambient temperature $T_{so}$, and the full-frozen temperature $T_R$ by means of the controller 60.

The ice-making temperature sensor 80 is provided in an ice-maker to detect the temperature of the ice-making tray 41. The ice-making temperature sensor 80 may be disposed at any place within the ice-maker. For example, as shown in FIG. 1, the ice-making temperature sensor 80 is provided under the ice-making tray 41 to thereby sense the temperature thereof. The ice-making temperature sensor 80 may sense the temperature of the ice-making try 41 simultaneously while water is supplied thereto and being frozen, or may start to detect the temperature after a desired freezing time.

The ambient temperature sensor 70 senses the ambient temperature surrounding the refrigerator. The sensing result by the ambient temperature sensor 70 is transmitted to the controller 60, which then determines whether the full-frozen temperature $T_R$ is re-adjusted based on the transmitted results.

If the ambient temperature $T_S$ sensed by the ambient temperature sensor 70 is lower than the reference ambient temperature $T_{SO}$, the controller 60 re-adjusts the set full-frozen temperature $T_R$ downwardly by certain desired degrees to continue the freezing procedures. When the temperature $T_1$ of the ice-making tray 41 sensed by the ice-making temperature sensor 80 reaches the re-adjusted full-frozen temperature $T'_R$, the controller 60 drives the ice-transfer motor 47 after a desired ice-transfer standby time $t_R$.

The controller 60 may be provided with a memory unit 63, thereby pre-storing a full-frozen temperature $T_R$ for determining whether or not the ice is fully frozen, a reference ambient temperature $T_{SO}$ for evaluating whether or not the full-frozen temperature is re-adjusted, and an ice-transfer standby time $t_R$ up to the driving of the ice-transfer motor 63 after the full-frozen temperature $T_R$ is reached. Here, the full-frozen temperature $T_R$, the reference ambient temperature $T_{SO}$, and the ice-transfer standby time $t_R$ may be pre-established and pre-stored in the refrigerator during the manufacturing thereof, or may be re-established by a user when needed. In addition, the above values do not need to be stored at the same time, for example, one or more values thereof may be stored. On the other hand, the memory unit 63 may be provided within the controller 60, or separately prepared outside of the controller 60.

When water starts to be supplied to the ice-making tray 41, the controller 60 compares the ambient temperature $T_S$ sensed by the ambient temperature sensor 70 with the set reference ambient temperature $T_{SO}$ and determines whether or not the full-frozen temperature is downwardly re-adjusted. Here, the ambient temperature sensor 70 may detect the ambient temperature $T_S$ continuously, or at certain time intervals. The reason why the controller 60 re-adjusts the full-frozen temperature $T_R$ based on the ambient temperature Ts is that, in the case of a lower ambient temperature $T_s$, a lower rate operation of the compressor can achieve the controlled temperature of the freezer 20, thereby not meeting the full-frozen requirements. That is, in order to supply cold air to the freezer 20, the compressor needs to be continuously operated. However, in the case of a lower ambient temperature $T_s$, even though the compressor is operated for a relatively shortened period of time, the controlled temperature of the freezer 20 can be easily achieved and thus the compressor stops. Therefore, even if the full-frozen temperature is met, the minimum cooling time required for full-frozen is not satisfied, thus resulting in hollow ice, which is then transferred as it is. In this case, the inside of the transferred ice is not fully frozen, thus degrading the ice quality. In addition, while transferring, the hollow ice is likely to be broken by an impact and be stuck together, thus leading to a defect during discharging to the outside. For reference, typically, the full-frozen temperature TR is set to be lower than the controlled temperature of the freezer 20, but the isolated ice-maker is provided at one side thereof with a cold air discharging port having a relatively large area such that a concentrated cooling can be performed to meet the full-frozen temperature $T_R$, which is lower than the controlled temperature.

Here, the reference ambient temperature $T_{SO}$ may vary with operating conditions of the refrigerator. As shown in FIG. 6, the reference ambient temperature $T_{SO}$ may be set to be in a range of 7~9° C., for example, to be 8° C. The full-frozen temperature $T_R$ and the re-adjusted full-frozen temperature $T'_R$ may also vary with operating conditions of the refrigerator. For example, if the ambient temperature $T_S$ is above 8° C., the full-frozen temperature $T_R$ may be set to be in a range of −17~−18° C. If the ambient temperature $T_S$ is less than 8° C., the re-adjusted full-frozen temperature $T'_R$ may be set to be in a range of −20~−21° C. Here, the reference ambient temperature $T_{SO}$, the full-frozen temperature $T_R$, and the re-adjusted full-frozen temperature $T'_R$ may vary with operating conditions of the refrigerator.

The controller 60 makes a decision as to whether the full-frozen temperature $T_R$ is to be re-adjusted, and then continues ice-making until the re-adjusted full-frozen temperature $T'_R$ is reached. Here, if the ambient temperature $T_S$ is no less than the reference ambient temperature $T_{SO}$, the re-adjusted full-frozen temperature $T'_R$ may be the initially set full-frozen temperature $T_R$. When the ambient temperature $T_S$ is less than the reference ambient temperature $T_{SO}$, the full-frozen temperature may be the re-adjusted full-frozen temperature $T'_R$. While ice-making, the controller 60 senses the temperature of the ice-making tray 41 through the ice-making temperature sensor 80. If the temperature of the ice-making tray 41 reaches the re-adjusted full-frozen temperature $T'_R$, the controller 60 finishes the ice-making and, after a desired ice-transfer standby time $t_R$, drives the ice-transfer motor 47 to perform ice-transferring. Therefore, in a case of a lower ambient temperature, the refrigerator according to the present invention downwardly re-adjusts the full-frozen temperature $T_R$ to make the ice-making requirements stricter so that full-frozen ice can be made in the ice-making tray 41, thus preventing not-fully frozen ice from being transferred.

Alternatively, in the case where the ambient temperature $T_S$ is lower than the reference ambient temperature $T_{SO}$, the controller 60 downwardly re-adjusts the above-described full-frozen temperature TR and also may extend the set ice-transfer standby time $t_R$. For example, when the set ice-transfer standby time $t_R$ is five minutes, the controller 60 may extend it to 7~10 minutes. In this case, the full-freezing requirements become stricter due to the downward re-adjustment of the full-frozen temperature and the extension of the ice-transfer standby time, so that the ice-maker can provide full-frozen ice. Here, alternatively, the ice-transfer standby time may be extended to make full-frozen ice, without re-adjusting the full-frozen temperature $T_R$. Here, the controller 60 may further include a timer 65 for counting the ice-transfer standby time $t_R$.

Figure 3:
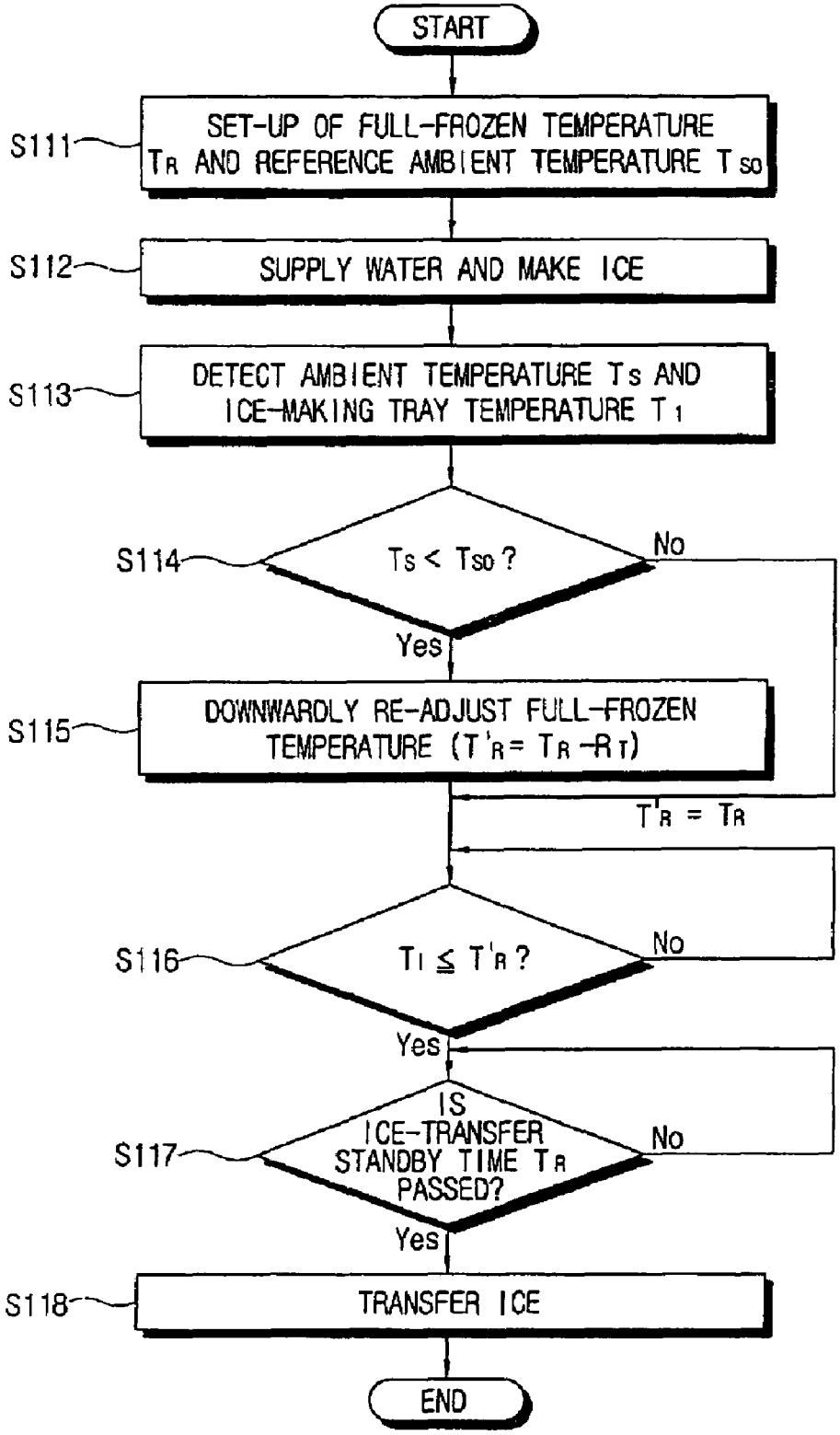
FIG. 3 is a flow chart illustrating a method of fully freezing ice in a refrigerator according to a first embodiment of the present invention.
Figure 4:
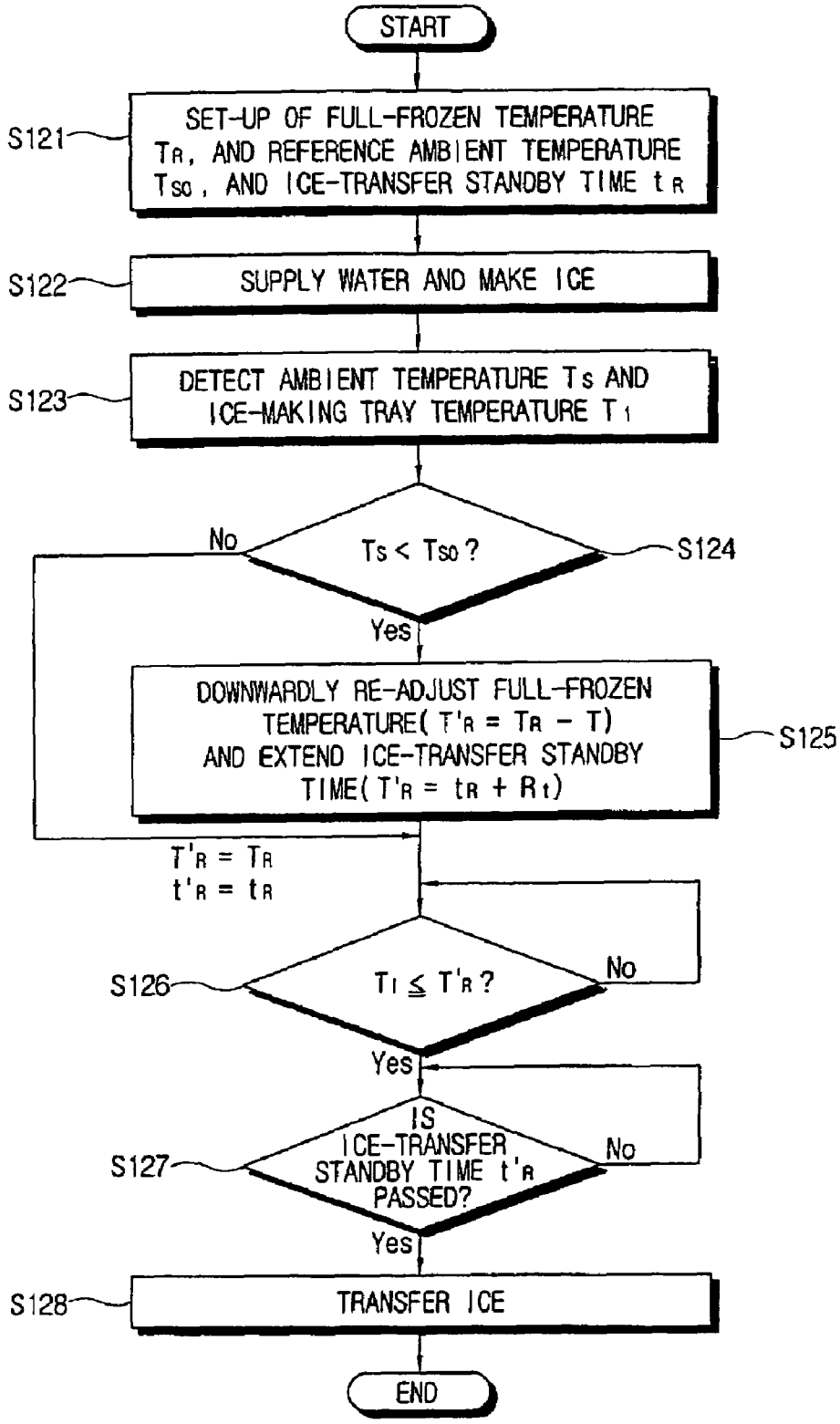
FIG. 4 is a flow chart illustrating a method of fully freezing ice in a refrigerator according to a second embodiment of the present invention.
Figure 5:
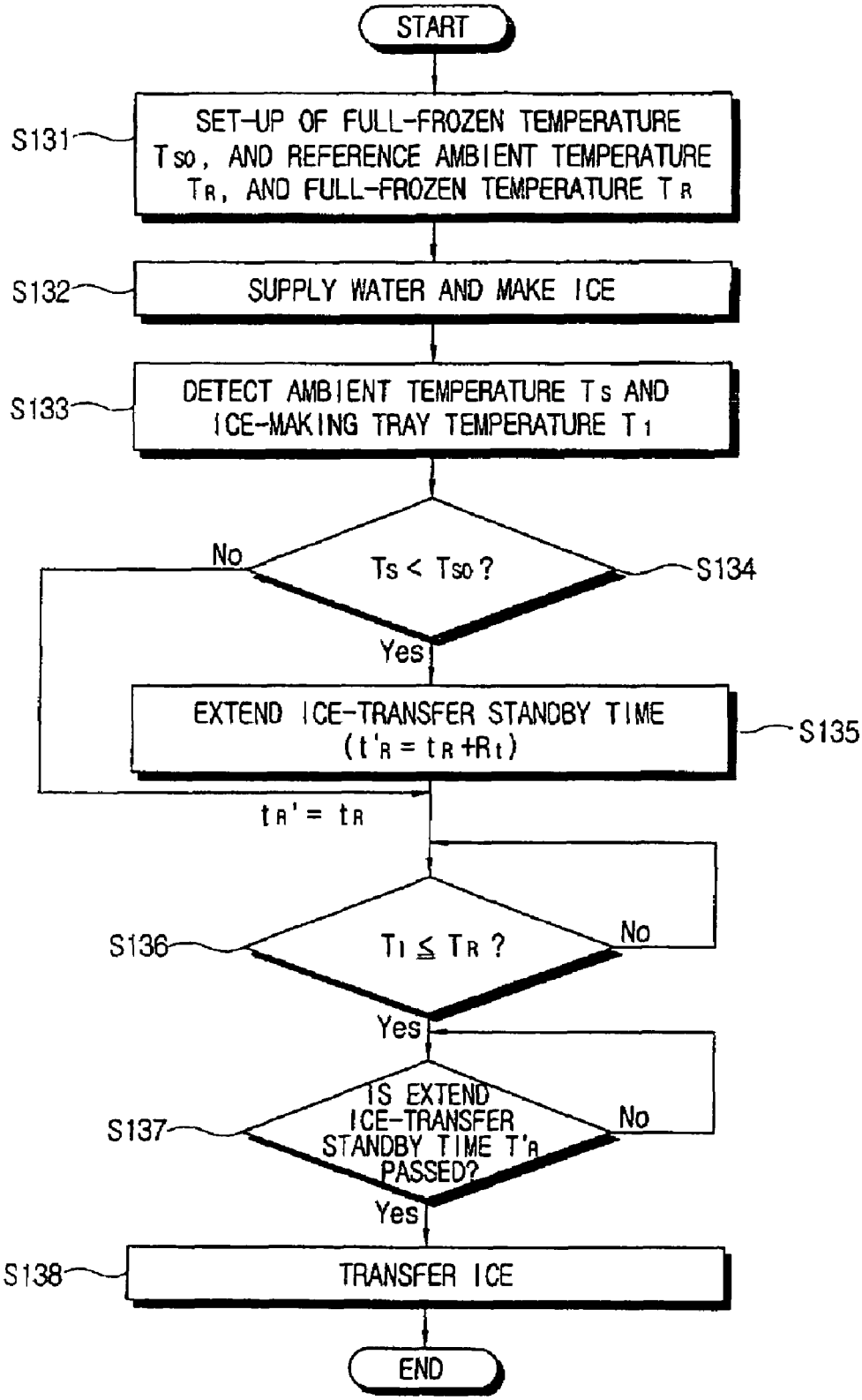
FIG. 5 is a flow chart illustrating a method of fully freezing ice in a refrigerator according to a third embodiment of the present invention.

A method of fully freezing ice in the refrigerator having the above-described construction will be explained, referring to FIGS. 3 to 5.

FIRST EMBODIMENT (FIG. 3)

In a first embodiment, when the ambient temperature $T_S$ is lower than the reference ambient temperature $T_{SO}$, the initially set full-frozen temperature $T_R$ is downwardly re-adjusted to make full-frozen ice. First, full-frozen requirements, that is, a full-frozen temperature $T_R$ and a reference ambient temperature $T_{SO}$ are set at operation S111. These conditions may be re-set by a user when required, but in general users may use the values set when manufactured. Water is supplied to the ice-making tray 41 through the water-supply tube 45 and ice-making starts at operation S112. When the ice-making starts, the ambient temperature sensor 70 senses the ambient temperature $T_S$ and the ice-making temperature sensor 80 senses the temperature of the ice-making tray 41 at operation S113. As the result of sensing, in the case where the ambient temperature $T_S$ is higher than the set reference ambient temperature $T_{SO}$, the set full-frozen temperature $T_R$ remains. If the ambient temperature $T_S$ is lower than the reference ambient temperature $T_{SO}$ at operation S114, the set full-frozen temperature $T_R$ is downwardly re-adjusted by certain desired degrees $R_T$ at operation S115. The controller 60 continues the ice-making process until the temperature of the ice-making tray 41 reaches the re-adjusted full-frozen temperature $T'_R$. If the re-adjusted full-frozen temperature $T'_R$ is detected by the ice-making temperature sensor 80 at operation S116, the controller 60 operates the ice-transfer motor 47 to transfer the ice from the ice-making tray 41 at operation S118, after the ice-transfer standby time $t_R$ elapses at operation S117.

As described above, according to the method of fully freezing ice in the refrigerator according to the first embodiment, even in the case of a lower ambient temperature, the ice-maker can provide full-frozen ice, thereby improving the ice quality and preventing sticking of ice, which may occur when not fully frozen ice is broken while being transferred.

SECOND EMBODIMENT (FIG. 4)

In a second embodiment, when the ambient temperature $T_S$ is lower than the reference ambient temperature $T_{SO}$, the initially set full-frozen temperature $T_R$ is downwardly re-adjusted and simultaneously the ice-transfer standby time $t_R$ is extended to thereby make full-frozen ice. First, full-frozen requirements, that is, a full-frozen temperature $T_R$, a reference ambient temperature $T_{SO}$ and an ice-transfer standby time $t_R$ are set at operation S121. Water is supplied to the ice-making tray 41 through the water-supply tube 45 and ice-making starts at operation S122. When the ice-making starts, the ambient temperature sensor 70 senses the ambient temperature $T_S$ and the ice-making temperature sensor 80 senses the temperature of the ice-making tray 41 at operation S123. As the result of sensing, in the case where the ambient temperature $T_S$ is higher than the set reference ambient temperature $T_{SO}$, the set-up full-frozen temperature $T_R$ remains. If the ambient temperature $T_S$ is lower than the reference ambient temperature $T_{SO}$ at operation S124, the set full-frozen temperature $T_R$ is downwardly re-adjusted by certain desired degrees $R_T$ and simultaneously the ice-transfer standby time $t_R$ is extended by certain desired time $R_t$ at operation S125. The controller 60 continues the ice-making process until the temperature of the ice-making tray 41 reaches the re-adjusted full-frozen temperature $T'_R$. If the re-adjusted full-frozen temperature $T'_R$ is detected by the ice-making temperature sensor 80 at operation S126, the controller 60 continues the ice-making process until the extended ice-transfer standby time $t'_R$ elapses at operation S127. If the extended ice-transfer standby time $t'_R$ elapses, the controller 60 operates the ice-transfer motor 47 to transfer the ice from the ice-making tray 41 at operation S128.

As described above, according to the method of fully freezing ice in the refrigerator according to the second embodiment of the invention, the ice-making conditions are made to be stricter such that the ice-maker can provide full-frozen ice more reliably.

THIRD EMBODIMENT (FIG. 5)

In a third embodiment, when the ambient temperature $T_S$ is lower than the reference ambient temperature $T_{SO}$, only the initially set-up ice-transfer standby time $t_R$ is extended to thereby make full-frozen ice. First, full-frozen requirements, that is, a full-frozen temperature $T_R$, a reference ambient temperature $T_{SO}$ and an ice-transfer standby time $t_R$ are set-up at operation S131. Water is supplied to the ice-making tray 41 through the water-supply tube 45 and ice-making starts at operation S132. When the ice-making starts, the ambient temperature sensor 70 senses the ambient temperature $T_S$ and the ice-making temperature sensor 80 senses the temperature of the ice-making tray 41 at operation S133. As the result of sensing, in the case where the ambient temperature $T_S$ is higher than the set-up reference ambient temperature $T_{SO}$, the set-up ice-transfer standby time $t_R$ remains. If the ambient temperature $T_S$ is lower than the reference ambient temperature $T_{SO}$ at operation S134, the ice-transfer standby time $t_R$ is extended by certain desired time $R_t$ at operation S135. The controller 60 continues the ice-making process until the temperature of the ice-making tray 41 reaches the set-up full-frozen temperature $T_R$. If the set-up full-frozen temperature $T_R$ is detected by the ice-making temperature sensor 80 at operation S136, the controller 60 continues the ice-making process until the extended ice-transfer standby time $t'_R$ elapses at operation S137. If the extended ice-transfer standby time $t'_R$ elapses, the controller 60 operates the ice-transfer motor 47 to transfer the ice from the ice-making tray 41 at operation S138.

As described above, according to the method of fully freezing ice in the refrigerator according to the third embodiment of the invention, the ice-transfer standby time is extended so that the ice-maker can provide full-frozen ice more reliably.

As described above, according to a method of fully freezing ice and a refrigerator using the method, fully-frozen ice can be provided even in the case of a lower ambient temperature, to thereby improve the ice quality, thus preventing sticking of ice, which may occur when not fully frozen ice is broken while being transferred.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of fully freezing ice in a refrigerator, which includes an ice-making tray and an ice-transfer motor for turning the ice-making tray to transfer frozen ice, the method comprising:

setting a full-frozen temperature for determining whether ice is fully frozen, and a reference ambient temperature for re-adjusting the full-frozen temperature;

supplying water to the ice-making tray to thereby perform ice-making;

sensing ambient temperature;

sensing temperature of the ice-making tray;

re-adjusting the full-frozen temperature by comparing the sensed ambient temperature with the reference ambient temperature; and if the temperature of the ice-making tray reaches the re-adjusted full-frozen temperature, driving an ice-transfer motor to transfer full-frozen ice from the ice-making tray.

2. The method as set forth in claim 1, wherein the re-adjusting the full-frozen temperature includes, if the sensed ambient temperature is lower than the reference ambient temperature, downwardly re-adjusting the full-frozen temperature.

3. The method as set forth in claim 2, further comprising:

setting an ice-transfer standby time of from when the ice-making tray reaches the full-frozen temperature to when the ice-transfer motor is driven; and if the temperature of the ice-making tray reaches the re-adjusted full-frozen temperature, driving the ice-transfer motor when the ice-transfer standby time elapses.

4. The method as set forth in claim 3, further comprising, if the ambient temperature is lower than the reference ambient temperature, extending the ice-transfer standby time; if the temperature of the ice-making tray reaches the re-adjusted full-frozen temperature, driving the ice-transfer motor when the extended ice-transfer standby time elapses.

5. The method as set forth in claim 1, wherein the reference ambient temperature is set to be in a range of 7~9° C.

6. The method as set forth in claim 5, wherein the set full-frozen temperature is in a range of −17~−18° C. and the re-adjusted full-frozen temperature is in a range of −20~−21° C.

7. The method as set forth in claim 3, wherein the ice-transfer standby time is five minutes and the extended ice-transfer standby time is 7~10 minutes.

8. A method of fully freezing ice in a refrigerator, which includes an ice-making tray and an ice-transfer motor for turning the ice-making tray to transfer frozen ice, the method comprising:

setting a full-frozen temperature for determining whether ice is fully frozen, an ice-transfer standby time at the full-frozen temperature, and a reference ambient temperature for re-adjusting the ice-transfer standby time;

supplying water to the ice-making tray to thereby perform ice-making;

sensing ambient temperature;

sensing temperature of the ice-making tray;

if the sensed ambient temperature is lower than the reference ambient temperature, extending the ice-transfer standby time; and if the temperature of the ice-making tray reaches the full-frozen temperature and when the ice-transfer standby time elapses, driving an ice-transfer motor to transfer full-frozen ice from the ice-making tray.

* * * * *